US011499215B2

(12) United States Patent
Deng et al.

(10) Patent No.: US 11,499,215 B2
(45) Date of Patent: Nov. 15, 2022

(54) METHOD AND PRODUCT FOR MANUFACTURING TITANIUM ALLOY DUAL-STRUCTURE TURBINE DISK BASED ON PARTIAL HYDROGENATION

(71) Applicant: HUAZHONG UNIVERSITY OF SCIENCE AND TECHNOLOGY, Hubei (CN)

(72) Inventors: Lei Deng, Hubei (CN); Xinyun Wang, Hubei (CN); Junsong Jin, Hubei (CN); Pan Gong, Hubei (CN); Wenbin Li, Hubei (CN)

(73) Assignee: HUAZHONG UNIVERSITY OF SCIENCE AND TECHNOLOGY, Hubei (CN)

( * ) Notice: Subject to any disclaimer, the term of this patent is extended or adjusted under 35 U.S.C. 154(b) by 316 days.

(21) Appl. No.: 16/817,593

(22) Filed: Mar. 12, 2020

(65) Prior Publication Data

US 2021/0285081 A1 Sep. 16, 2021

(51) Int. Cl.

| | |
|---|---|
| ***C22F 1/18*** | (2006.01) |
| ***B21D 22/02*** | (2006.01) |
| ***F01D 5/14*** | (2006.01) |

(52) U.S. Cl.

CPC ..... *C22F 1/183* (2013.01); *B21D 22/02* (2013.01); *F01D 5/14* (2013.01); *F05D 2230/40* (2013.01); *F05D 2300/174* (2013.01)

(58) Field of Classification Search

CPC .... B21K 1/28; B21K 1/32; B21J 1/003; B21J 3/00; F05D 2300/174; F05D 2230/40; F05D 2230/25; F01D 5/14; F01D 5/02; B21D 22/02; C22F 1/183

See application file for complete search history.

(56) References Cited

FOREIGN PATENT DOCUMENTS

CN 109652749 A * 4/2019 ..... C21D 1/72

* cited by examiner

*Primary Examiner* — Moshe Wilensky
(74) *Attorney, Agent, or Firm* — JCIPRNET

(57) ABSTRACT

The invention provides a method and a product for manufacturing a titanium alloy dual-structure turbine disk based on partial hydrogenation, which includes the following steps: coating a glass coating on the partial surface of a titanium alloy billet where hydrogen-blocking is required, and sintering the titanium alloy billet coated with the glass coating; performing hydrogenation treatment on the titanium alloy billet, such that the hydrogen concentration at the hydrogenation-required portion reaches the predetermined level; removing the glass coating from the titanium alloy billet; preheating the titanium alloy billet, and then performing high temperature die forging in the forging dies; performing vacuum dehydrogenation treatment on the forged turbine disk to remove hydrogen element inside the forging, so that the hydrogen content is 0.015 wt. % or less.

9 Claims, 2 Drawing Sheets

METHOD AND PRODUCT FOR MANUFACTURING TITANIUM ALLOY DUAL-STRUCTURE TURBINE DISK BASED ON PARTIAL HYDROGENATION

BACKGROUND

Technical Field

The disclosure belongs to the field of aero engine parts manufacturing, and more particularly relates to a method and a product for manufacturing titanium alloy dual-structure turbine disks based on partial hydrogenation.

Description of Related Art

Turbine disk is one of the most important components in aerospace engines. It is operated under harsh working conditions, so requirements on the performance of materials is high. First of all, the working temperature of the turbine disk is high, which can reach 1000K. Secondly, the working frequency of the turbine disk is high, and the rotational speed can reach more than 10000 rpm. In addition, the working conditions of the turbine disk are different for different positions of the turbine disk. The wheel hub part bears a large load, but the working temperature thereof is relatively low, the wheel rim part works at a high working temperature, and bears less stress.

In order to meet the performance requirements of turbine disks, the typical approach is to enlarge the size of the turbine disk to improve its performance and to be able to work in a harsher working environment. However, this method will significantly increase the weight of the aerospace engine and the production cost, which does not meet the requirements for reduction of aerospace weight and production cost. Therefore, the method of forming dual-structure turbine disks has become more common.

Dual-structure turbine disk, that is, the wheel hub part has higher yield strength and low cycle fatigue strength, and the wheel rim part has higher fracture toughness and creep resistance. At present, the methods for making dual-structure turbine disks include the dual alloy method and the single alloy method. The dual alloy method uses two alloy materials in the wheel hub and wheel rim parts respectively to meet the performance requirements of the wheel hub and the wheel rim, respectively. However, this method can hardly solve the problem of the weak connection between the wheel hub and the wheel rim and the smooth transition of structural performance. The technical bottleneck of dual-alloy dual-structure turbine disks is difficult to be overcome, which indirectly promotes the development of single-alloy dual-structure turbine disks. In order to achieve the dual performance requirements, the crystal grains of the wheel hub portion need to be equiaxed structure, and the crystal grains of the wheel rim portion are net structure. Moreover, it is also necessary to ensure that the transition portion between the wheel rim and the wheel hub has good continuous structural performance. Otherwise, during the working process of the dual-structure turbine disk, the region with discontinuous structural performance will be prone to fracture and other defects, which will cause fatal failure to aerospace engine. In order to achieve good continuity of structural performance, the current method is mainly to perform gradient thermal processing and gradient heat treatment on dual-structure turbine disks. However, gradient heat treatment has high requirements for the accuracy of temperature gradients, which makes it difficult to achieve smooth transition on the structural performance of the wheel rim and wheel hub portions, and the problem of "weak connections" in the transition region still exists.

The ideal structure of the titanium alloy dual-structure turbine disk is that the wheel hub portion is an equiaxed structure, and the wheel rim portion is a net structure or Widmanstatten structure. In addition to adopting the gradient heat treatment, the structure of wheel rim and wheel hub can be controlled by controlling the amount of deformation during forging. In this method, it is required that the billet is first heated to a temperature above the transformation point temperature for heat preservation, and then quenched to obtain a large amount of acicular martensite. During the forging process, it is controlled that the wheel rim has a large amount of deformation and the wheel hub has a small amount of deformation, so that the acicular martensite in the wheel rim portion is deformed and fractured, and then decomposed into an equiaxed structure during the subsequent heat treatment. The martensite in the wheel hub part remains acicular and is decomposed into a net structure during the subsequent heat treatment. The defect of this method is that it is difficult to accurately control the structure of the transition region, and the continuity of the structural performance in the transition region is not good. In order to solve this problem, the patent with the publication number CN 101629273 B proposes a method which accurately controls the deformation amount of each region through multiple local loads on basis of the above, and is capable of controlling the final structure of the transition region to be a bimorphic structure. However, the forming process and heat treatment steps of the above method are complicated and require multiple forgings.

SUMMARY

In order to meet the performance requirements of titanium alloy dual-structure turbine disks and overcome the shortcomings of conventional technology, the present disclosure provides a method and product for manufacturing titanium alloy dual-structure turbine disk based on partial hydrogenation, which controls the hydrogen content in different regions of the round billet of turbine disk by means of partial hydrogen-blocking during hydrogenation, such that the final forged turbine disk has the wheel hub portion which is an equiaxed structure, and the wheel rim portion is a Widmanstatten structure. Meanwhile, the transition portion between the wheel hub and the wheel rim has continuous structural performance and there is no weak connection.

In order to achieve the above purpose, according to one aspect of the present disclosure, a method for manufacturing a titanium alloy dual-structure turbine disk based on partial hydrogenation is provided, which includes the following steps:

S1: coating a glass coating on the partial surface of the round titanium alloy billet which does not require hydrogenation, and sintering the titanium alloy billet coated with the glass coating at a glass coating softening temperature;

S2: placing the sintered titanium alloy billet in a vacuum hydrogenation furnace for hydrogenation, and keeping the sintered titanium alloy billet at a required hydrogenation temperature for a period of time, such that the hydrogen element diffuses inward from the lateral side of the titanium alloy billet, so that the content of hydrogen in the titanium alloy billet is distributed in gradient from outside to inside along radial direction, and the hydrogen content at the configuration position of the wheel rim and the transition region between the wheel rim and the wheel hub reaches the predetermined concentration, and then the furnace is cooled to room temperature;

S3: taking out the titanium alloy billet that has been treated with hydrogenation, and removing the glass coating on the titanium alloy billet;

S4: preheating the titanium alloy billet from which the glass coating has been removed to the specific forging temperature, so that the structure of the wheel hub not subjected to hydrogenation is a α+β phase structure, and the structure of the wheel rim subjected to hydrogenation is a β phase structure. Then, the preheated titanium alloy billet is subjected to high temperature die forging and cooled to room temperature;

S5: the turbine disk obtained by die forging is subjected to vacuum dehydrogenation treatment to remove hydrogen elements inside the forging, so that the hydrogen content is less than 0.015 wt. %.

As a more preferable embodiment, the sintering temperature in step S1 is 900° C.±50° C., and the sintering time is 30 minutes.

As a more preferable embodiment, the thickness of the glass coating in step S1 is controlled between 30 μm and 50 μm, and the slurry of the glass coating is a material that does not generate chemical reaction with the surface of the titanium alloy.

As a more preferable embodiment, the glass coating is coated on the upper and lower surfaces of the round titanium alloy billet, while the glass coating is not coated on the lateral side of the billet.

As a more preferable embodiment, in step S2, the hydrogenation temperature is 750° C., and the inner boundary of the wheel rim is set to be at a distance equivalent to 25% of the radius of the billet away from the lateral side, and the hydrogen content at the wheel rim is set to be 0.08 wt. % to 0.15 wt. %. The transition region is set at a distance equal to 50% of the radius of the billet away from lateral side, and the hydrogen content at the transition region is set to be less than 0.08 wt. %.

As a more preferable embodiment, the time for temperature keeping in step S2 is calculated by using the following formula:

$$C(x, t) = C_0 + (C_s - C_0)\left[1 - erf\left(\frac{x}{2\sqrt{Dt}}\right)\right]$$

In the formula, $C_0$ is the original hydrogen concentration of the material, $C_s$ is the atmospheric hydrogen concentration, t is the keeping time, and C(x, t) is the hydrogen content at the position that is at a distance x away from the lateral side of the round billet when the keeping time is t, and D is the diffusion coefficient of hydrogen atoms in a titanium alloy.

As a more preferable embodiment, the preheating temperature of the titanium alloy billet in step S4 is between the β-transformation temperature of the transition region subjected to hydrogenation and the β-transformation temperature of the wheel rim subjected to hydrogenation, and the temperature keeping time is 1 hour.

As a more preferable embodiment, the deformation amount of the wheel hub during the high temperature die forging process in step S4 is 50% to 70%, and the deformation amount of the wheel rim is 50% or less.

As a more preferable embodiment, the temperature for vacuum dehydrogenation treatment in step S5 is 700° C., and the treatment time is 4 hours.

According to another aspect of the present disclosure, a titanium alloy dual-structure turbine disk manufactured based on partial hydrogenation is provided, which is manufactured by using the above method.

In general, compared with the related art, the above technical solutions provided by the present disclosure mainly have the following advantageous technical features:

1. As compared with the dual-structure turbine disk formed by the existing process, the titanium alloy dual-structure turbine disk formed by the method of the present disclosure adopts a simpler forming method, has better continuity in the structural performance of the transition region, and does not require gradient thermal processing and gradient heat treatment. Besides, the step for billet preparation is simple, fewer processing steps are required, and the steps of subsequent heating treatment are simple.

2. The temperature for high-temperature die forging process in the present disclosure is between the β-transformation temperature of the transition region subjected to hydrogenation and the β-transformation temperature of the wheel rim subjected to hydrogenation, such that the content of equiaxed a phase of the structure at the wheel hub after forming is high, thereby forming the equiaxed structure, and the content of equiaxed a phase in the transition region is relatively low, thereby forming the two-state structure in which the equiaxed a and the lamellar structure coexist, and the wheel rim with high hydrogen content forms the Widmanstatten structure or the net structure.

DESCRIPTION OF THE EMBODIMENTS

Figure 1:
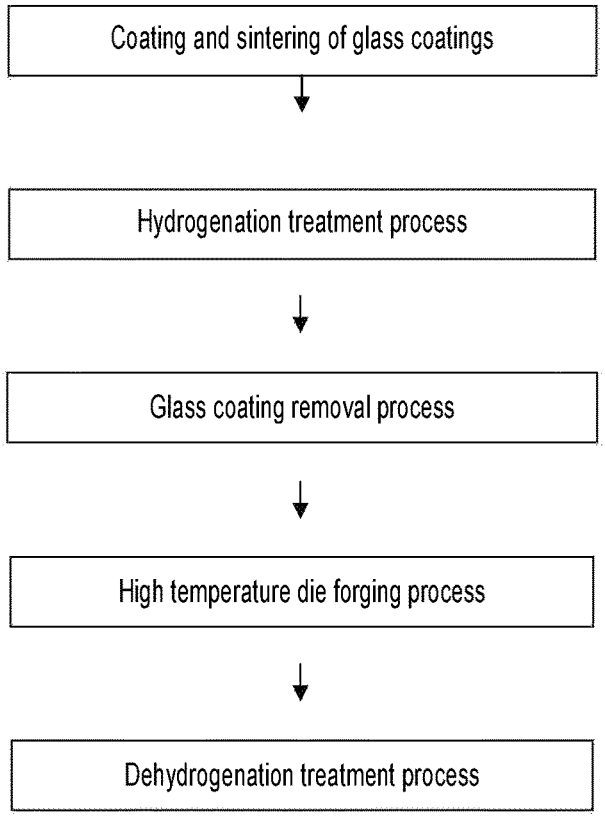
FIG. 1 is a flowchart of a method for manufacturing a titanium alloy dual-structure turbine disk based on partial hydrogenation according to the present disclosure.

In order to make the objectives, technical solutions, and advantages of the present disclosure clearer, the following further describes the present disclosure in detail with reference to the accompanying drawings and embodiments. It should be understood that the specific embodiments described herein are only used to explain the present disclosure and are not intended to limit the present disclosure. In addition, the technical features involved in the embodiments of the present disclosure described below can be combined with each other as long as they do not conflict with each other.

In order to solve the problem of weak connection of titanium alloy dual-structure turbine disks and also simplify the production process, the present disclosure provides a method for manufacturing a titanium alloy dual-structure turbine disk based on partial hydrogenation on basis of titanium alloys hydrogenation treatment theory. By coating glass coating on the upper and lower surfaces of the round titanium alloy billet to prevent the diffusion of hydrogen, and the lateral region is not coated with the glass coating so as to allow permeation of hydrogen, it is possible to realize that the gradient of hydrogen content from the edge to the center of the billet along radial direction is reduced, and then high temperature die forging is performed. In the region where titanium alloy is subjected to hydrogenation, the original β-transformation point will decrease. The higher the hydrogen content, the greater the transformation point temperature drops. By controlling the hydrogen content in the billet from the outside to the inside, it is possible to achieve die forging deformation in different states at different region of the titanium alloy billet, so as to obtain different structural performance.

The method in the disclosure can realize the requirements for equiaxed structure on the hub and net structure on the wheel rim. The basic principle is that, first of all, the hydrogen content from the wheel rim to the transition region is distributed in gradient from the outside to the inside (the content is gradually decreased) through hydrogenation, such that β-transformation temperature from the transition region to the material at the wheel rim is gradually decreased. Thereafter, preheating is performed at the die forging preheating temperature (between the β-transformation temperature of the transition region subjected to hydrogenation and the β-transformation temperature of the wheel rim subjected to hydrogenation). Since the β-transformation temperature from the wheel hub to the wheel rim is gradually decreased, the die forging preheating temperature is lower than the β-transformation temperature of the wheel hub, and the wheel hub structure is a α+β-phase structure; the die forging preheating temperature is close to the β-transformation temperature of the transition region, and the transition region is a α+β phase structure; the die forging preheating temperature is higher than the β-transformation temperature of the wheel rim, phase transformation will occur, and the wheel rim structure is a β-phase structure. Finally, die forging deformation is performed at the die forging preheating temperature, the deformation amount of the wheel hub is large, and the deformation amount of wheel rim is small, then the wheel hub structure is dynamically recrystallized to generate an equiaxed structure with fine crystal grains. Since the die forging preheating temperature is close to the β-transformation temperature at the transition region, the equiaxed crystal grains grow larger under the die forging deformation, and part of them turns into lamellar structures, such that the transition region forms the two-state structure where the equiaxed structure and the lamellar structure coexist. As for the wheel rim, under the effect of smaller deformation amount, a net structure or Widmanstatten structure is obtained.

As shown in FIG. 1, a method for manufacturing a titanium alloy dual-structure turbine disk based on partial hydrogenation provided by an embodiment of the present disclosure includes the following steps:

S1: Hydrogen-Blocking Glass Coating Preparing, Coating and Sintering Processes

To prepare glass coating slurry, a brushing method is adopted to apply the glass coating slurry to a part of the titanium alloy billet where hydrogen-blocking is required. The coating should be applied uniformly to avoid generation of air bubbles, and sintering is performed at a softening temperature, i.e., 900° C.±50° C., of the glass slurry, then kept at the softening temperature for 30 minutes. Through the above sintering process, the glass coating can be more stably fixed on the surface of the billet. The glass coating covers the upper and lower surfaces of the titanium alloy billet, while the lateral side of the billet is not coated, please refer to FIG. 3 for specific illustration. Accordingly, the hydrogen element can enter from the lateral side of the billet, so as to achieve the purpose of reducing the hydrogen content in gradient from the outside to the inside of the billet.

Specifically, the thickness of the glass coating is controlled between 30 μm and 50 μm, which can effectively achieve the purpose of blocking hydrogen. The glass master batch is a material that does not generate chemical reaction with the surface of the titanium alloy. After sintering, the coating is combined with the surface of titanium alloy through intermolecular force, which makes it convenient to perform the subsequent removal operation.

S2: Hydrogenation Treatment Process

The sintered titanium alloy billet is placed in a vacuum hydrogenation furnace for performing hydrogenation, and the hydrogenation temperature is 750° C. The hydrogen partial pressure is adjusted, and the temperature (that is, the hydrogenation time) is maintained for a period of time, so that the wheel rim and transition region that need to be subjected to hydrogenation are provided with the required hydrogen concentration, and then the furnace is cooled to room temperature. Specifically, the hydrogen content at the wheel rim is set to be 0.08 wt. % to 0.15 wt. %, and the hydrogen content at the transition region is set to be less than 0.08 wt. %. Accordingly, the β transformation temperature at different regions of the titanium alloy reduces to the required temperature range, so it is convenient for determining the preheating temperature for the die forging, and the hydrogenation time is calculated by using the following formula:

$$C(x, t) = C_0 + (C_s - C_0)\left[1 - erf\left(\frac{x}{2\sqrt{Dt}}\right)\right] \quad (1)$$

In the formula, $C_0$ is the original hydrogen concentration of the material; $C_s$ is the atmospheric hydrogen concentration (the mass fraction of hydrogen in the hydrogenation atmosphere, which can be obtained by calculating the hydrogen partial pressure), and $C_s$ can be set as needed; t is the hydrogenation time, D is the diffusion coefficient of hydrogen atoms in the titanium alloy; C(x, t) is the hydrogen content at the position that is at a distance x away from the outer side of the billet when the hydrogenation time is t, for example, the hydrogen content C(x, t) at the position at a distance equivalent to 25% of the radius of the billet away from the outer side of the wheel rim is 0.08 wt. % to 0.15 wt. %, and the hydrogen content C(x, t) at the position at a distance equal to 50% of the radius of the wheel rim away from outer side of the wheel rim is less than 0.08 wt. %. When the size of the billet is set, the magnitude of the above x is a known parameter.

S3: Removal Process of Glass Coating

The titanium alloy billet that has been subjected to hydrogenation is taken out, and is subjected to sand blasting in a sand blasting machine to peel the surface off and remove the coating.

S4: High Temperature Die Forging Process

The titanium alloy billet from which the glass coating has been removed is preheated to a forging temperature that is between the β-transformation temperature of the transition region subjected to hydrogenation and the β-transformation temperature of the wheel rim subjected to hydrogenation, the temperature is at the lower half part of the α+β phase region of the titanium alloy that is not subjected to hydrogenation. The temperature is maintained for a certain time so that the billet is completely heated, such that the wheel hub structure that is not subjected to hydrogenation is a structure in the α+β phase region. The transition region structure that is subjected to hydrogenation is a structure in the α+β phase region, the wheel rim structure that is subjected to hydrogenation is the structure in the β phase region. Then, the preheated titanium alloy billet is moved to the forging dies preheated to 400° C. to perform high temperature die forging for different deformation amounts. After the die forging is performed, the forged part is cooled to room temperature. Specifically, the deformation amount of the wheel hub is 50% to 70%, the deformation amount of the wheel rim is less than 50%, the deformation amount of the transition region is maintained to be consistent with that of the wheel rim, such that the wheel hub portion is subject to large deformation to obtain the equiaxed structure, the deformation amount of the wheel rim portion is small and obtain the Widmanstatten structure or the net structure.

S5: Dehydrogenation Process

The turbine disk obtained by die forging is subjected to vacuum dehydrogenation treatment at a temperature of 700° C., and the treatment time is 4 hours to remove the hydrogen element inside the forging so that the hydrogen content is less than 0.015 wt. %, and internal stress is eliminated to decompose steady phase.

The method of the present disclosure will be described in detail by taking a TC4 titanium alloy dual-structure turbine disk as an example.

(a) Preparation of glass slurry. The specific composition of the slurry is 50% of $SiO_2$ by mass fraction, 20% of $B_2O_3$ by mass fraction, 5% of $Na_2O$ by mass fraction, 5% of $Li_2O$ by mass fraction, 5% of $ZrO_2$ by mass fraction, 5% of $TiO_2$ by mass fraction, and the remaining is 10% of CaO by mass fraction. The prepared glass slurry is evenly coated on the upper and lower surfaces of the wafer-shaped billet, sintered at 950° C., the temperature is maintained for 30 minutes, and the thickness of coating is controlled to be 30 to 50 μm.

Figure 2:
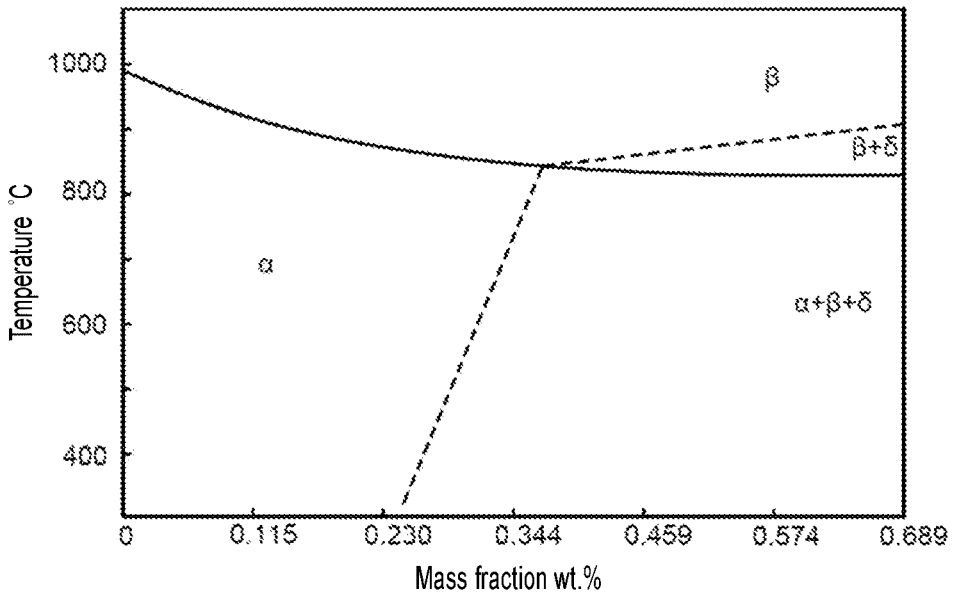
FIG. 2 is a phase diagram of a TC4-xH system.
Figure 3:
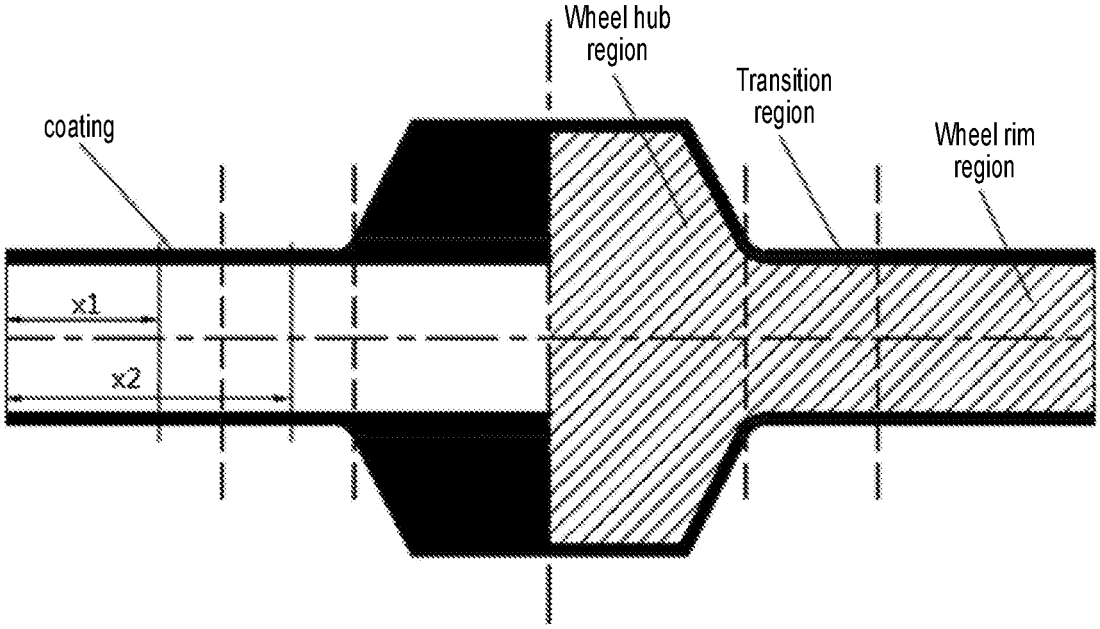
FIG. 3 is a schematic view showing the billet shape, coating and region division.

(b) As shown in FIG. 3, the size of the TC4 titanium alloy billet is as follows: the outer edge diameter is φ600 mm, the center diameter of the wheel hub is φ240 mm, the height of the wheel hub is 300 mm, the height of the wheel rim portion is 200 mm. The TC4 titanium alloy billet covered by the coating is placed in a vacuum hydrogenation furnace to perform hydrogenation. The temperature of the hydrogenation furnace is maintained at 750° C., the hydrogen partial pressure is controlled. The hydrogen content C(x, t) at the position at a distance equivalent to 25% (i.e., x1=25% x600/2=75 mm, as shown in FIG. 3) of the radius of the billet away from the outer side is set to be 0.15 wt. %. The hydrogen content C(x, t) at the position at a distance equivalent to 50% (i.e., x2=50% x600/2=150 mm, as shown in FIG. 3) of the radius of the billet away from the outer side is set to be 0.07 wt. %. Based on the above formula (1), the temperature maintaining time is calculated to be 120 minutes. Hydrogenation is performed under the above-mentioned hydrogenation process, so that the hydrogen content of the billet gradually decreases from the outside to the inside and is distributed in gradient, and the hydrogen content at somewhere of the wheel rim of the billet is 0.15 wt. %, the hydrogen content at somewhere of the transition region is 0.07 wt. %. According to FIG. 2, it can be obtained that the β transformation temperature of the wheel rim portion that is subjected to hydrogenation is 880° C., and the β transformation temperature of the transition region subjected to hydrogenation is 930° C. After hydrogenation is completed, the furnace is cooled.

(c) The hydrogenation-treated billet is sandblasted in a sandblasting machine to remove the hydrogen-blocking glass coating from the surface, and then the surface is cleansed to remove impurities.

(d) The billet that has been partially hydrogenated is subjected to high-temperature die forging. The billet is heated to 900° C. (between 880° C. and 930° C.), and maintained for 1 hour, so that the billet is fully heated. Then the billet is placed in the forging dies of which the temperature is maintained at 400° C., wherein the deformation amount of the wheel hub is 60%, the deformation amount of the wheel rim is less than 40%, and the deformation amount in the transition region is the same as that of the wheel rim. The furnace is cooled to room temperature after forging.

(e) The formed turbine disk is vacuum dehydrogenation at a temperature of 700° C. and the temperature maintaining time is 4 hours. Then the furnace is cooled to room temperature, and the furnace is maintained vacuum to reduce the hydrogen content of the turbine disk to be less than 0.015 wt. %.

The wheel rim portion of the above prepared TC4 titanium alloy dual-structure turbine disk is a Widmanstatten structure with larger crystal grains, which has good fracture toughness and creep resistance. The wheel hub is an equiaxed structure with fine crystal grains and has a high yield strength as well as low-cycle fatigue strength. The structure of the transition region between the wheel hub and the wheel rim is a two-state structure, and the performance thereof is between the Widmanstatten structure and the equiaxed structure. Accordingly, both of the wheel hub and the wheel rim have good structural performance transition, thereby avoiding the problem of weak connection.

The disclosure adopts partial hydrogenation to obtain billets of turbine disk with different hydrogen contents in different parts, then completes the forming of a titanium alloy dual-structure turbine disk through die forging, thereby obtaining different structural performance in the wheel hub and the wheel rim, and achieving the Widmanstatten structure or net structure that has good fracture toughness and creep resistance, and the wheel hub portion is an equiaxed structure with high yield strength as well as low-cycle fatigue strength. Therefore, not only the performance requirement of wheel hub and wheel rim can be obtained, it is also possible to realize continuous wheel hub structure and wheel rim structure, smooth transition, and the whole manufacturing process is simple and can be easily controlled.

Those skilled in the art can easily understand that the above description is only the preferred embodiments of the present disclosure and is not intended to limit the present disclosure. Any modification, equivalent replacement, and improvement made within the spirit and principle of the present disclosure should be included in the protection scope of the present disclosure.

What is claimed is:

1. A method for manufacturing a titanium alloy dual-structure turbine disk based on partial hydrogenation, comprising the following steps:

S1: coating a glass coating on the partial surface of the round titanium alloy billet which does not require hydrogenation, and sintering the titanium alloy billet coated with the glass coating at a glass coating softening temperature;

S2: placing the sintered titanium alloy billet in a vacuum hydrogenation furnace for hydrogenation, and keeping the sintered titanium alloy billet at a required hydrogenation temperature for a period of time, such that the hydrogen element diffuses inward from the lateral side of the titanium alloy billet, so that the content of hydrogen in the titanium alloy billet is distributed in gradient from outside to inside along radial direction, and the hydrogen content at the configuration position of the wheel rim and the transition region between the wheel rim and the wheel hub reaches the predetermined concentration, and then the furnace is cooled to room temperature;

S3: taking out the titanium alloy billet that has been treated with hydrogenation, and removing the glass coating on the titanium alloy billet;

S4: preheating the titanium alloy billet from which the glass coating has been removed to the specific forging temperature, so that the structure of the wheel hub not subjected to hydrogenation is a α+β phase structure, and the structure of the wheel rim subjected to hydrogenation is a β phase structure, Then, the preheated titanium alloy billet is subjected to high temperature die forging and cooled to room temperature;

S5: the turbine disk obtained by die forging is subjected to vacuum dehydrogenation treatment to remove hydrogen elements inside the forging, so that the hydrogen content is less than 0.015 wt. %.

2. The method for manufacturing the titanium alloy dual-structure turbine disk based on partial hydrogenation according to claim 1, wherein the sintering temperature in step S1 is 900° C.±50° C., and the sintering time is 30 minutes.

3. The method for manufacturing the titanium alloy dual-structure turbine disk based on partial hydrogenation according to claim 1, wherein the thickness of the glass coating in step S1 is controlled between 30 μm and 50 μm, and the slurry of the glass coating is a material that does not generate chemical reaction with the surface of titanium alloy.

4. The method for manufacturing the titanium alloy dual-structure turbine disk based on partial hydrogenation according to claim 1, wherein the glass coating is coated on upper and lower surfaces of the round titanium alloy billet, and the glass coating is not coated on the lateral side of the billet.

5. The method for manufacturing the titanium alloy dual-structure turbine disk based on partial hydrogenation according to claim 1, wherein in step S2, the hydrogenation temperature is 750° C., and the inner boundary of the wheel rim is set to be at a distance equivalent to 25% of the radius of the billet away from the lateral side, and the hydrogen content at the wheel rim is set to be 0.08 wt. % to 0.15 wt. %, The transition region is set at a distance equal to 50% of the radius of the billet away from lateral side, and the hydrogen content at the transition region is set to be less than 0.08 wt. %.

6. The method for manufacturing the titanium alloy dual-performance turbine disk based on partial hydrogenation according to claim 1, wherein the temperature maintaining time in step S2 is calculated by using the following formula:

$$C(x, t) = C_0 + (C_s - C_0)\left[1 - erf\left(\frac{x}{2\sqrt{Dt}}\right)\right]$$

in the formula, $C_0$ is the original hydrogen concentration of the material, $C_s$ is the atmospheric hydrogen concentration, t is the keeping time, and C(x, t) the hydrogen content at the position that is at a distance x away from the lateral side of the round billet when the keeping time is t, and D is the diffusion coefficient of hydrogen atoms in a titanium alloy.

7. The method for manufacturing the titanium alloy dual-performance turbine disk based on partial hydrogenation according to claim 1, wherein the preheating temperature of the titanium alloy billet in step S4 is between the β-transformation temperature of the transition region subjected to hydrogenation and the β-transformation temperature of the wheel rim subjected to hydrogenation, and the temperature keeping time is 1 hour.

8. The method for manufacturing the titanium alloy dual-structure turbine disk based on partial hydrogenation according to claim 1, wherein the deformation amount of the wheel hub during the high temperature die forging process in step S4 is 50% to 70%, and the deformation amount of the wheel rim is 50% or less.

9. The method for manufacturing the titanium alloy dual-structure turbine disk based on partial hydrogenation according to claim 1, wherein the temperature for vacuum dehydrogenation treatment in step S5 is 700° C., and the treatment time is 4 hours.

* * * * *